US006647908B2

(12) United States Patent
Meyer et al.

(10) Patent No.: US 6,647,908 B2
(45) Date of Patent: Nov. 18, 2003

(54) MICROPROCESSOR-ASSISTED SEWING MACHINE CONTROL EQUIPMENT

(75) Inventors: Bernd Meyer, Paderborn (DE); Sevki Hosagasi, Bielefeld (DE); Andree Cramer, Detmold (DE); Horst Seibert, Bielefeld (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/375,234

(22) Filed: Feb. 27, 2003

(65) Prior Publication Data

US 2003/0164128 A1 Sep. 4, 2003

(30) Foreign Application Priority Data

Mar. 2, 2002 (DE) ..... 102 09 317

(51) Int. Cl.[7] ..... D05B 21/00
(52) U.S. Cl. ..... 112/470.06
(58) Field of Search ..... 112/470.01, 470.06, 112/102.5, 66, 68, 73; 70/136, 137, 138

(56) References Cited

U.S. PATENT DOCUMENTS 4,258,636 A * 3/1981 Rolauffs et al. .... 112/470.06 X
4,457,242 A * 7/1984 Nordstrom ..... 112/470.04
4,459,926 A 7/1984 Ohniwa
4,787,326 A 11/1988 Scholl et al.
6,095,066 A 8/2000 Noltge et al.

FOREIGN PATENT DOCUMENTS

DE 32 13 277 11/1982
DE 35 40 273 5/1986

* cited by examiner

*Primary Examiner*—Peter Nerbun
(74) *Attorney, Agent, or Firm*—McGlew and Tuttle, P.C.

(57) ABSTRACT

A microprocessor-assisted sewing machine control equipment is flexibly applicable for controlling the sewing machine driving motor and further electric motors which are controlled independently of or in dependence on the rotary position. To this end, a control system is allocated to each electric motor, comprising an open-loop control unit for rotary-position-independent controlling, a closed-loop control unit for controlling the electric motor in dependence on the rotary position, and a selection unit. The selection unit couples for control either the closed-loop control unit or the open-loop control unit with the electric motor, depending on whether the electric motor is controlled by closed-loop control in dependence on the rotary position or by open-loop control independently of the rotary position.

10 Claims, 1 Drawing Sheet

MICROPROCESSOR-ASSISTED SEWING MACHINE CONTROL EQUIPMENT

BACKGROUND OF THE INVENTION

1. Field of the Invention

The invention relates to a microprocessor-assisted sewing machine control equipment comprising a computer unit with a memory for a sewing machine control program; and a power output unit with drivers for power controlling a controlled sewing machine driving motor and at least another electric motor; the sewing machine driving motor being controlled by closed-loop control through a control system in dependence on its rotary position; and the at least one electric motor being controlled in a manner tuned to the position of the sewing machine driving motor.

2. Background Art

A control equipment of the generic type is known from U.S. Pat. No. 4,787,326 A. The basic control equipment structure there used includes a computer unit with a memory in the form of a data carrier in which to deposit a sewing-machine control program. This controls an automatic sewing machine which comprises a work piece holder that is movable in two coordinate directions and a sewing head that is rotary about an axis and serves for producing a seam on a work piece in accordance with a pattern given by the program. Electric motors are provided, producing the motion of the work piece holder and the rotation of the sewing head; they are triggered for power via a power output unit with corresponding drivers in the same way as the sewing machine driving motor.

The sewing machine driving motor is controlled and triggered by a control equipment in dependence on its rotary position. The electric motors, which are equipped with rotary-position transmitters, are triggered in a manner tuned to the position of the driving motor of the sewing machine.

Drawbacks of the known control equipment reside in that it is designed for practical application in a specific case. For an electric motor that is to be triggered irrelevantly of the position of rotation, a simple open-loop control unit is provided, having no rotary-position signal feedback; whereas a corresponding closed-loop control unit inclusive of rotary-position signal feedback is employed for an electric motor that is controlled in dependence on the position of rotation. If a sewing device of a different type is to be triggered, which comprises additional electric motors of deviating configuration, a specifically suited controlling equipment must be created. This implies highly complicated development and manufacturing jobs accompanied with correspondingly high manufacturing cost, because special construction of the respective control equipment is needed, which will as a rule be implemented by small-scale manufacture.

SUMMARY OF THE INVENTION

Proceeding from these problems, it is an object of the invention to develop the known sewing machine control equipment such that it is universally employable regardless of the specific configuration of the connected electric motors and the control thereof in dependence on, or independently of, the position of rotation.

This gist of the invention is the controlling system that is allocated to a respective electric motor, creating the necessary all-purpose character. This control system comprises an open-loop control unit for triggering the electric motor regardless of the position of rotation as well as a closed-loop control unit for controlled triggering of the electric motor in dependence on the rotary position and on the basis of a rotary-position signal emitted by a rotary-position detector that is disposed on the electric motor. A selection unit that is allocated to the open-loop and closed-loop control units provides for either the open-loop or the closed-loop control unit, in dependence on the configuration of the connected electric motor, to be coupled for control with this motor. If the electric motor has to be controlled in dependence on the rotary position, the closed-loop control unit is coupled in circuit with the electric motor, whereas, in the case of control regardless of the rotary position, the open-loop control unit is coupled via the selection unit.

Given the above-mentioned basic architecture and a certain number of identical control units for a corresponding number of electric motors, the entire control equipment according to the invention can virtually be suited to the controlling requirements of the electric motors in circuit. Regardless of this, the actual sewing machine driving motor for needle motion is customarily controlled in dependence on the rotary position.

Details of the invention will become apparent from the ensuing description of an exemplary embodiment, taken in conjunction with the drawing.

DESCRIPTION OF THE PREFERRED EMBODIMENT

Figure 1:
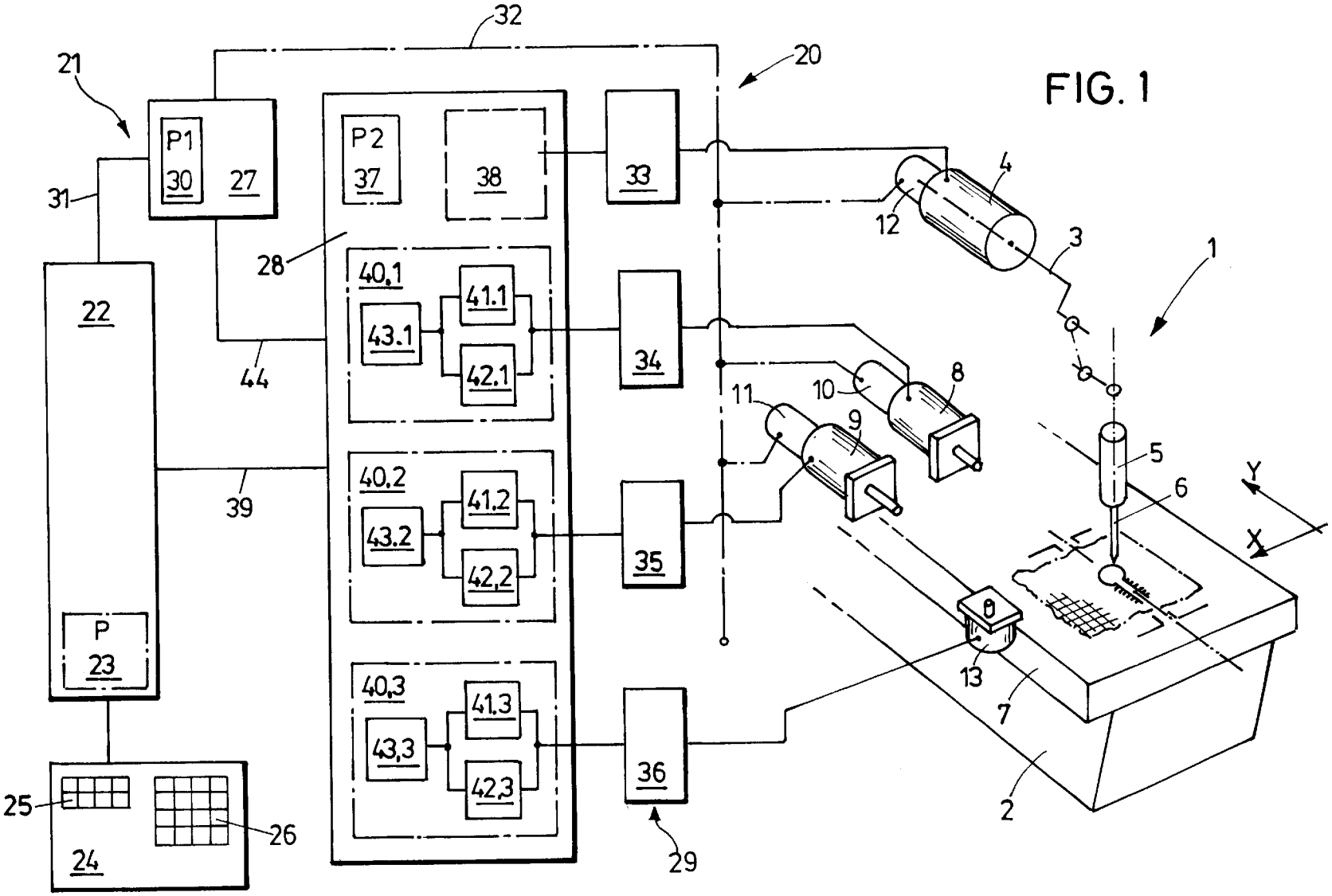
FIG. 1 is a diagrammatic perspective view of a sewing machine with an allocated control equipment in a block diagram.

The sewing machine 1, which is seen on the right in the drawing, is roughly outlined by its lower base plate 2 in the form of a casing, whereas the so-called standard and the arm of the machine have been omitted. A shaft 3 is customarily housed in the arm; it is drivable by a driving motor 4. Actuation of a vertically displaceable needle bar 5 with a needle 6 is conventionally derived from the shaft 3.

Disposed on the base plate 2 is an x-y table 7, which is a cross slide that is movable in two horizontal coordinate directions, namely the x and the y direction. The x-y table 7 is of conventional design, which is known for instance from U.S. Pat. No. 6,095,066 A. Actuation of the x-y table 7 in the two coordinate directions takes place by the aid of electric motors 8, 9, the motor 8 of which being the x drive and the motor 9 being the y drive. The electric motors 8, 9 are positioning motors, as a rule stepper motors or adjustable d.c. motors. Both motors 8, 9 are provided to be triggered in a manner controlled in dependence on the rotary position so that each is equipped with a rotary-position transmitter 10, 11. A rotary-position transmitter 12 of this type is also customarily disposed on the sewing-machine driving motor 4.

Another electric motor 13 serves as a displacement drive for a support plate (not shown) on the x-y table 7. The electric motor 13 is a stepper motor that can be triggered independently of the position of rotation. In this regard, no rotary-position transmitter is provided for this electric motor 13.

The microprocessor-assisted control equipment, which is designated by 20 in its entirety, is provided for sewing-machine 1 operation control. It has a computer unity 1 as a central component, comprising a master processor 22 and a non-volatile, resident memory 23. This so-called flash memory 23 permanently stores the complete sewing-machine control program P, which includes various program units such as the actual operation program, corresponding drivers for peripheral components, operating programs for service functions, and further program units P1 and P2 for control-equipment 20 components that remain to be explained in detail.

Operating the sewing machine 1 and the control equipment 20 takes place by way of a control panel 24 that is allocated to the master processor 22 and comprises a display 25 and a keyboard 26. The corresponding interface components and drivers for control-panel 24 operation and communication are commercial and have been omitted in the drawing for reason of clarity.

The control equipment 20 includes as further basic components: a logical unit 27, a signal processor designated by 28 in its entirety, as well as a power output unit 29 for triggering the motors 4, 8, 9 and 13 for power.

The logical unit 27 includes a volatile memory 30 which is charged with the program unit P1 of the complete control program P via a line 31 from the master processor 22. This program unit P1 comprises for instance logical linkages for the corresponding circuit operations for triggering the motors 4, 8, 9, and 13.

For detection of the current position and the current speed of the motors 4, 8 and 9, which are controlled in dependence on the rotary position, the signals of the rotary-position transmitters 10, 11 and 12 are coupled back to the logical unit 27 via the group of lines 32.

The signal processor 28 serves for generating the actual control signals for operation of the motors 4, 8, 9, and 13 which are triggered for power via the drivers 33, 34, 35, 36 of the power output unit 29.

The signal processor 28 comprises a volatile memory 37 in which to store the program unit P2 of the complete control program P via a line 39 from the master processor 22 upon start-up of the sewing-machine control. The program unit P2 controls the components of the signal processor in the way specified below.

For example, the control system 38 for the actual driving motor 4 is controlled thereby; the motor 4 is controlled in dependence on the rotary position. Feedback of the rotary-position signal takes place in the way explained via the group of lines 32 and the logical unit 27.

Furthermore, the signal processor 28 is equipped with a control system 40.1, 40.2, 40.3 for each of the three motors 8, 9 and 13. These control systems 40 are structured identically, which is why only the first control system 40.1 will be explained below. It comprises an open-loop control unit 41.1 that generates corresponding signals for triggering the electric motor 8 regardless of the rotary position. A closed-loop control unit 42.1 is integrated, which is disposed in parallel to the open-loop control unit 41.1 and oriented for triggering, in dependence on the rotary position, the electric motor that is connected thereto—in this case the electric motor 8. Again information of the rotary-position transmitter 10 is accessed by way of feedback via the groups of lines 32 and the logical unit 27 which is connected to the signal processor 28 via the command line 44.

Finally, a selection unit 43.1 is allocated to the open-loop control unit 41.1 and the closed-loop control unit 42.1; it can be put into practice by software or hardware in the form of an OR component, by means of which to couple for control either the open-loop control unit 41.1 or the closed-loop control unit 42.1 with the electric motor 8. The selection unit 43.1, 43.2 of the two control systems 40.1, 40.2, which are allocated to the electric motors 8, 9 that are controlled in dependence on the rotary position, provides that the closed-loop control units 42.1. 42.2 are activated and responsible for triggering the electric motors in dependence on the rotary position. In the control system 40.3, the selection unit 43.3 has activated the open-loop control unit 41.3 in order to control the electric motor 13 via the corresponding driver 36 independently of the rotary position.

The selection units 43.1, 43.2, 43.3 themselves are software-controlled by way of the program unit P2 in the memory component 37 and selectively adjusted in accordance with instructions.

For completion, start-up of the control equipment 20 and of the sewing machine 1 will be roughly outlined below. Upon start of the control equipment 20 and mains supply via a mains adapter (not shown), the master processor 22 is caused to charge the memory 30 of the logical unit 27 with the program unit P1 deposited in the resident memory 23 and the memory 37 of the signal processor 28 with the program unit P2. This memory architecture has the advantage that any program updating—for instance in the case of modified logical linkages within the logical unit 27 or in the case of adjustments of signal-processor-28 control algorithms—may take place centrally by modification of the control program P in the resident memory 23.

The selection units 43.1, 43.2, 43.3 are triggered via the program unit P2 in the memory 37 so that, according to the described exemplary embodiment, the electric motors 8 and 9 are looped by a closed control circuit via the closed-loop control units 42.1, 42.2. The electric motor 13 is triggered without a closed control circuit i.e., without rotary-position feedback via the open-loop control unit 41.3.

The instructions relevant to closed-loop and open-loop control of all the motors 4, 8, 9 and 13 are also contained in the program unit P2.

Once the signal processor 28 has been put into operation, the master processor 22 communicates with the signal processor 28 via the line 39 for exchange of command and/or control data.

If, in a deviating sewing machine, the electric motor 9 is operated independently of the rotary position without feedback of the rotary position of the motor, the only thing to be modified within the control program P is the command to the control system 40.2 to the effect that the selection unit 43.2 activates the open-loop control unit 41.2. Otherwise the entire control equipment 20 may be used without any modification in hardware and software.

The entire control structure of the control equipment 20 is implemented preferably on a single board (not shown).

In conclusion, the invention provides for a flexible, adaptable and universally applicable control for various types of sewing machines which, depending on the respective application, permits operation of the sewing machine and—depending on the rotary motion thereof in accordance with a master-slave axis control—triggering of further axes in the form of electric motors. The mode of operation thereof—with or without rotary-position feedback—is independently definable by program.

What is claimed is:

1. A microprocessor-assisted sewing machine control equipment, comprising a computer unit (21) with a memory (23, 30, 37) for a sewing machine control program; and a power output unit (29) with drivers (33–36) for power controlling a controlled sewing machine driving motor (4) and at least another electric motor (8, 9, 13);

the sewing machine driving motor (4) being controlled by closed-loop control through a control system (38) in dependence on its rotary position;

the at least one electric motor (8, 9, 13) being controlled in a manner tuned to the position of the sewing machine driving motor (4); and a control system (40) which is allocated to the at least one electric motor (8, 9, 13), comprising an open-loop control unit (41.1, 41.2, 41.3) for controlling the at least one electric motor (13) independently of the rotary position;

a closed-loop control unit (42.1, 42.2, 42.3) for controlling the at least one electric motor (8, 9) in dependence on the rotary position, based on a rotary-position signal of a rotary-position detector (10, (11) that is disposed on the electric motor (8, 9); and a selection unit (43.1, 43.2, 43.3) which is allocated to the open-loop and closed-loop control units (41.1, 41.2, 41.3; 42.1, 42.2, 42.3) and by which one of the closed-loop control unit (42.1, 42.2, 42.3) and the open-loop control unit (41.1, 41.2, 41.3) is coupled for control with the electric motor (8, 9, 13), depending on whether the electric motor (8, 9, 13) is controlled by closed-loop control in dependence on the rotary position or by open-loop control independently of the rotary position.

2. A sewing machine control equipment according to claim 1, wherein the selection unit (43.1, 43.2, 43.3) is a circuit arrangement in a form of a logical OR component, producing a connection between the computer unit (21) and one of the open-loop control unit (41) and the closed-loop control unit (42).

3. A sewing machine control equipment according to claim 1, comprising several control systems (40.1, 40.2, 40.3) of identical design for a corresponding number of electric motors (8, 9, 13).

4. A sewing machine control equipment according to claim 1, wherein the control systems (38, 40) for the sewing machine driving motor (4) and for the at least one electric motor (8, 9, 13) are combined on a signal processor (28).

5. A sewing machine control equipment according to claim 4, wherein allocated to the signal processor (28) is a volatile memory (37) of its own for a control program (P2) for the sewing machine driving motor (4) and for the electric motor/s (8, 9, 13).

6. A sewing machine control equipment according to claim 1, wherein the memory of the control equipment (20) includes a resident memory (23) and at least a volatile memory (30, 37).

7. A sewing machine control equipment according to claim 6, wherein the computer unit (21) comprises a master processor (22) with the resident memory (23) and a logical unit (27).

8. A sewing machine control equipment according to claim 7, wherein the logical unit (27) comprises a volatile memory (30), which combines with the volatile memory (37) of the signal processor (28), forming the volatile memory of the control equipment.

9. A sewing machine control equipment according to claim 7, wherein the logical unit (27) and the signal processor (28) with the selection units (43) are looped in the way of a master-slave control by the master processor (22) and the resident memory (23) thereof.

10. A sewing machine control equipment according to claim 1, wherein the entire control structure is integrated into a board.

* * * * *